US011815824B2

(12) United States Patent
Mukaibara et al.

(10) Patent No.: US 11,815,824 B2
(45) Date of Patent: Nov. 14, 2023

(54) IMAGE FORMING APPARATUS THAT GENERATES TEST IMAGE GROUP HAVING PLURALITY OF TEST IMAGES

(71) Applicant: CANON KABUSHIKI KAISHA, Tokyo (JP)

(72) Inventors: Takuya Mukaibara, Shizuoka (JP); Kazutaka Yaguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/706,243

(22) Filed: Mar. 28, 2022

(65) Prior Publication Data

US 2022/0317611 A1 Oct. 6, 2022

(30) Foreign Application Priority Data

Mar. 31, 2021 (JP) ..... 2021-061654

(51) Int. Cl.
*G03G 15/00* (2006.01)
*G03G 15/01* (2006.01)

(52) U.S. Cl.
CPC ..... *G03G 15/5041* (2013.01); *G03G 15/01* (2013.01)

(58) Field of Classification Search
CPC . G03G 15/01; G03G 15/5041; G03G 15/5054
See application file for complete search history.

(56) References Cited

U.S. PATENT DOCUMENTS

| | | | | |
|---|---|---|---|---|
| 5,287,162 | A | 2/1994 | de Jong et al. | |
| 6,300,968 | B1 * | 10/2001 | Kerxhalli | G03G 15/0152 347/116 |
| 9,927,752 | B2 | 3/2018 | Ito et al. | |
| 10,191,428 | B2 | 1/2019 | Yamazaki et al. | |
| 2014/0037343 | A1 * | 2/2014 | Nakashima | G03G 15/0131 399/301 |
| 2021/0278792 | A1 | 9/2021 | Mukaibara et al. | |

FOREIGN PATENT DOCUMENTS

| | | | |
|---|---|---|---|
| JP | 06-118735 | A | 4/1994 |
| JP | 11-84759 | A | 3/1999 |
| JP | 2003-207976 | A | 7/2003 |
| JP | 2010-191414 | A | 9/2010 |

* cited by examiner

*Primary Examiner* — Walter L Lindsay, Jr.
*Assistant Examiner* — Andrew V Do
(74) *Attorney, Agent, or Firm* — Venable LLP

(57) ABSTRACT

An apparatus can obtain an amount of color misregistration based on a plurality of test images. Among these test images, the first test image has one line segment of a first color and another line segment of the first color. The second test image has one line segment of the first color and another line segment of a second color or has one line segment of the second color and another line segment of the first color. The third test image has one line segment of the second color and another line segment of the second color. The fourth test image has one line segment of the second color and another line segment of a third color or has one line segment of the third color and another line segment of the second color. The fifth test image has one line segment of the third color and another line segment of the third color.

10 Claims, 17 Drawing Sheets

IMAGE FORMING APPARATUS THAT GENERATES TEST IMAGE GROUP HAVING PLURALITY OF TEST IMAGES

BACKGROUND OF THE INVENTION

Field of the Invention

The present invention relates to an image forming apparatus that generates a test image group having a plurality of test images.

DESCRIPTION OF THE RELATED ART

In image forming apparatuses that form a color image, there is a requirement that color misregistration be small. Japanese Patent Laid-Open No. H06-118735 and Japanese Patent Laid-Open No. H11-084759 propose detecting the amount of color misregistration by forming a plurality of chevron marks using toners of different colors and detecting them by sensors.

According to Japanese Patent Laid-Open No. H06-118735 and Japanese Patent Laid-Open No. H11-084759, a sensor for detecting a ridge on the right side and a sensor for detecting a ridge on the left side of a chevron mark are used. However, a detection error occurring when these sensors are installed so as to be misaligned from an ideal position (a nominal position) assumed in advance in the design has not been considered.

SUMMARY OF THE INVENTION

The present invention provides an image forming apparatus comprising an image carrier; an image forming unit configured to form a test image group for obtaining an amount of color misregistration on the image carrier, using toners of a plurality of colors that are different from each other; a detection unit configured to detect the test image group carried by the image carrier; wherein the test image group includes a first test image, a second test image, a third test image, a fourth test image, and a fifth test image that are formed at different positions in order in a moving direction of the image carrier, each of the first test image to the fifth test image includes two line segments formed at different positions in a width direction perpendicular to the moving direction, the first test image has one line segment formed of toner of a first color and another line segment formed of toner of the first color, the second test image has one line segment formed of toner of the first color and another line segment formed of toner of a second color or has one line segment formed of toner of the second color and another line segment formed of toner of the first color, the third test image has one line segment formed of toner of the second color and another line segment formed of toner of the second color, the fourth test image has one line segment formed of toner of the second color and another line segment formed of toner of a third color or has one line segment formed of toner of the third color and another line segment formed of toner of the second color, and the fifth test image has one line segment formed of toner of the third color and another line segment formed of toner of the third color.

Further features of the present invention will become apparent from the following description of exemplary embodiments (with reference to the attached drawings).

DESCRIPTION OF THE EMBODIMENTS

Figure 1:
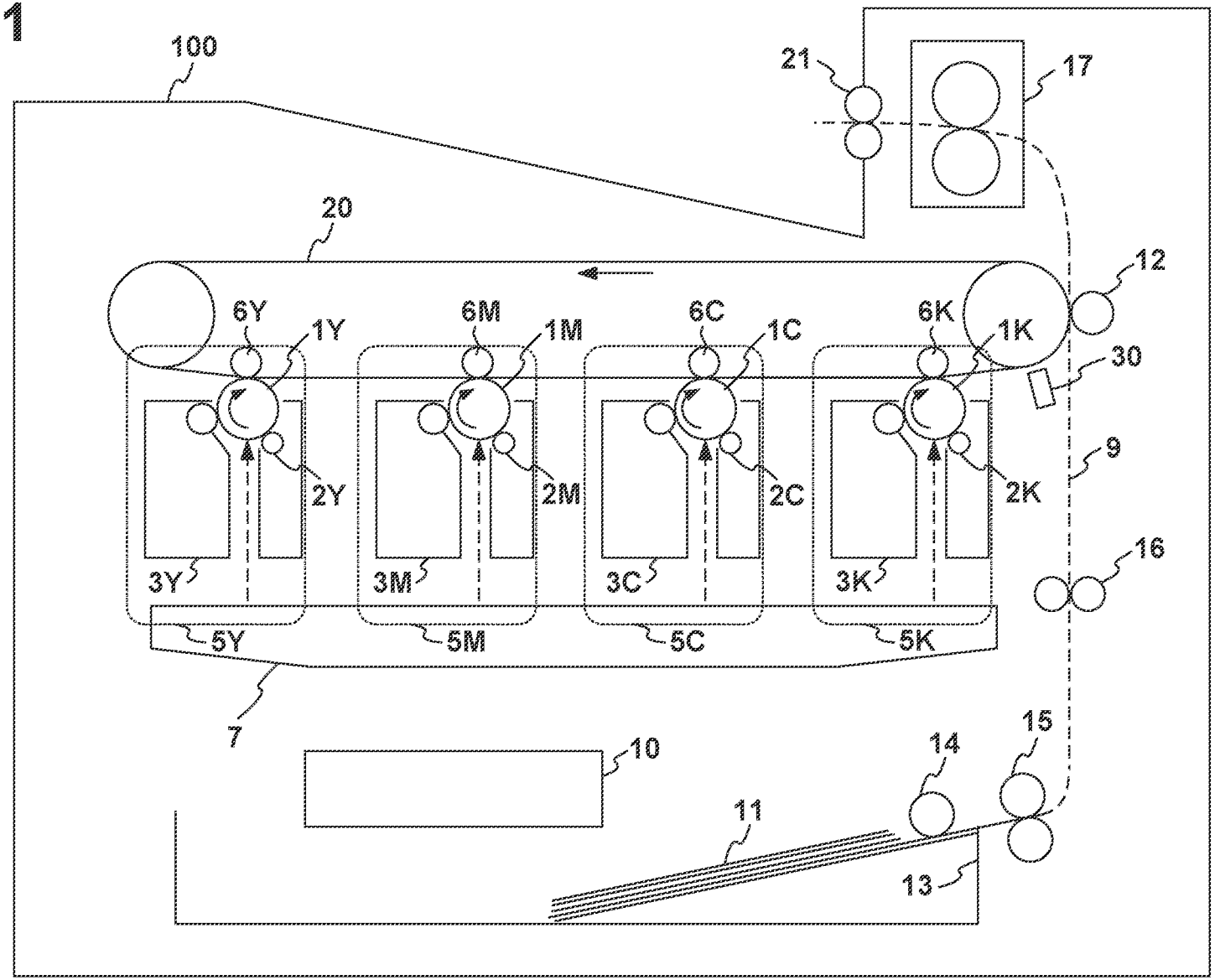
FIG. 1 is a diagram for explaining an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to used for the same or similar configurations, and redundant description thereof is omitted.

First Embodiment

Image Forming Apparatus

As illustrated in FIG. 1, an image forming apparatus 100 is a color printer that forms a toner image on a sheet 11 using an electrophotographic process. Y, M, C, and K added to the ends of reference numerals are abbreviations for yellow, magenta, cyan, and black. When colors need not be distinguished, the characters Y, M, C, and K are omitted from the reference numerals. An image forming unit 5 includes a photosensitive body 1, a charging device 2, a developing device 3, and a primary transfer roller 6, which are provided for each color. Further, the image forming apparatus 100 includes an exposure device 7.

The charging device 2 uniformly charges the surface of the photosensitive body 1. The exposure device 7 irradiates the photosensitive body 1 with a laser beam in accordance with an image signal supplied from a control unit 10 to form an electrostatic latent image corresponding to the image signal. The developing device 3 develops the electrostatic latent image using toner to form a toner image. The primary transfer roller 6 transfers the toner image from the photosensitive body 1 to an intermediate transfer belt 20. Here, a yellow toner image, a magenta toner image, a cyan toner image, and a black toner image are transferred so as to overlap each other on the intermediate transfer belt 20. The intermediate transfer belt 20 conveys the toner image to a secondary transfer unit.

A sheet cassette 13 is a container for storing a large number of sheets 11. Conveying rollers 14, 15, and 16 convey the sheet 11 stored in the sheet cassette 13 to the secondary transfer unit via a conveying path 9. A secondary transfer roller 12 provided in the secondary transfer unit transfers the toner image to the sheet 11. A fixing device 17 applies heat and pressure to the toner image and the sheet 11 to fix the toner image onto the sheet 11. A discharge roller 21 discharges the sheet 11 out of the image forming apparatus 100.

Incidentally, the position at which to transfer the toner image depends on the timing at which the exposure device 7 starts writing with a laser beam. That is, when the timings at which writing of the YMCK laser beams start is not at an appropriate timing in relation to each other, so-called color misregistration occurs. Color misregistration is a phenomenon in which the position at which a toner image of a certain color is formed and the position at which a toner image of another color is formed are misregistered. As more specific cases of color misregistration, there are cases where the position at which a toner image is formed is misregistered in a main scanning direction, the position at which a toner image is formed is misregistered in a sub-scanning direction, the magnification in the main scanning direction of a toner image is misregistered from the ideal magnification, a toner image is tilted in the sub-scanning direction, and the like, among others.

An optical sensor 30 is a sensor that detects a toner image (a test image) formed on the intermediate transfer belt 20. The control unit 10 controls the exposure device 7 and the image forming unit 5 to form a test image on the intermediate transfer belt 20 and detects the test image with the optical sensor 30. The control unit 10 corrects color misregistration of toner images or corrects the density of toner images based on a detection result of the test image. In the following, the direction in which the surface of the intermediate transfer belt 20 moves is referred to as a V direction, the sub-scanning direction, or a conveying direction. The direction perpendicular to the sub-scanning direction is referred to as an H direction, the main scanning direction, or a width direction.

Optical Sensor

Figure 2:
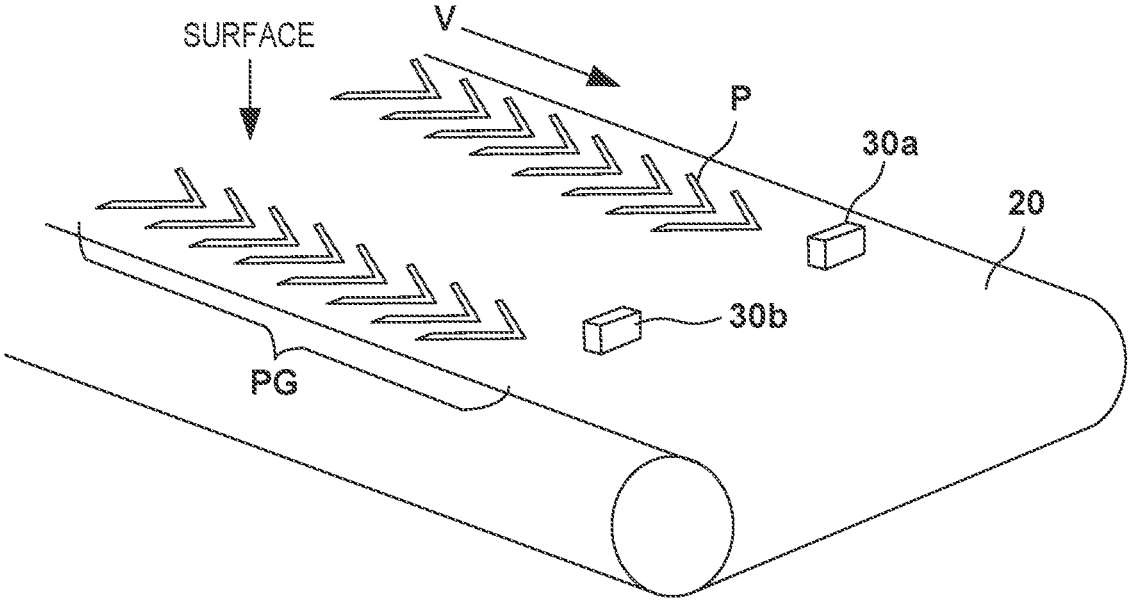
FIG. 2 is a diagram for explaining groups of patterns formed on an intermediate transfer belt.

According to FIG. 2, an optical sensor 30*a* detects a test image group (a pattern group PG including a plurality of patterns P) formed in one end region of the intermediate transfer belt 20. An optical sensor 30*b* detects a pattern group PG formed in the other end region of the intermediate transfer belt 20. In this specification, the optical sensors 30*a* and 30*b* are collectively denoted as an optical sensor 30.

Figure 3A:
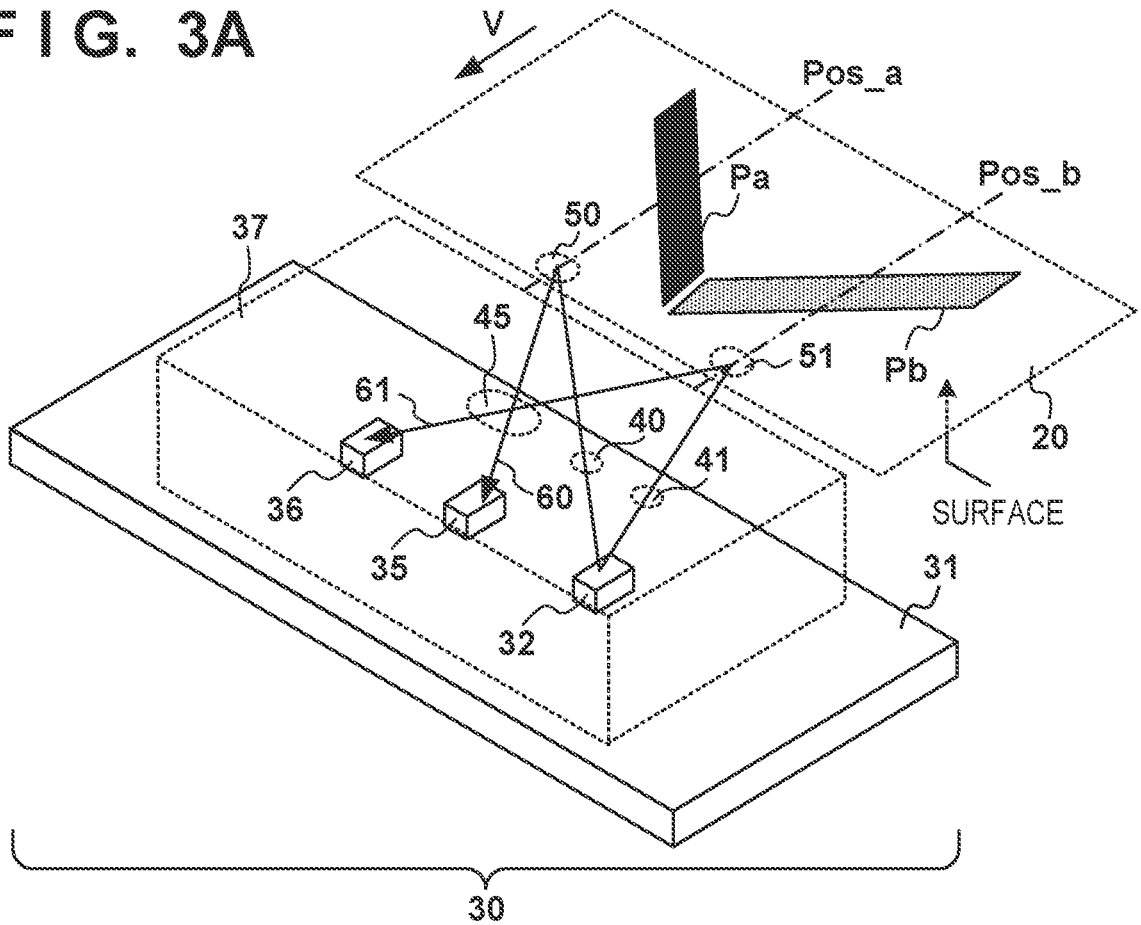
FIGS. 3A and 3B are diagrams for explaining an optical sensor.
Figure 3B:
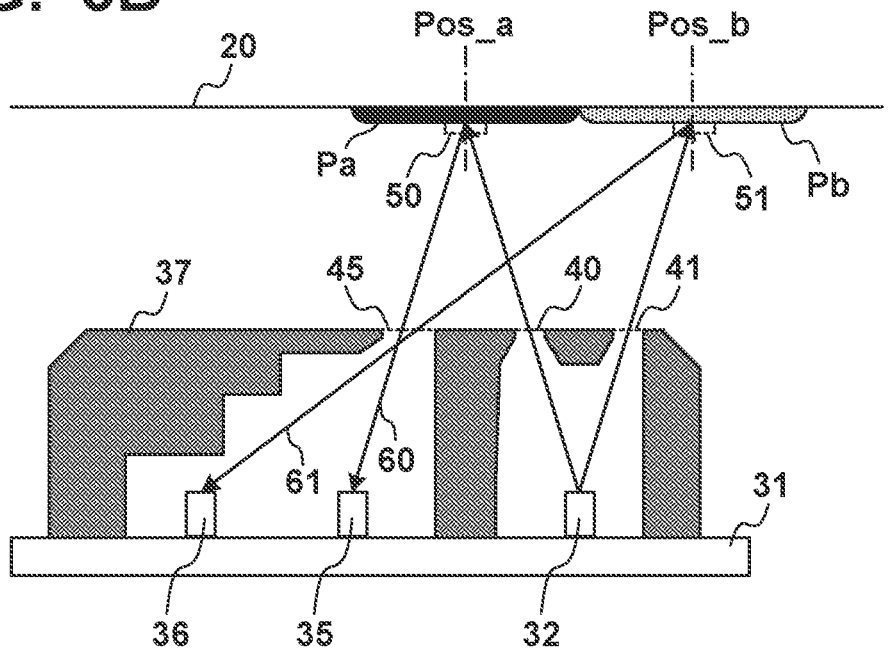

FIG. 3A is a perspective view of the optical sensor 30. FIG. 3B is a cross-sectional view of the optical sensor 30. The optical sensor 30 includes a light emitting element (LED 32) provided on a printed circuit board 31 and light receiving elements (PDs 35 and 36). LED is an abbreviation for light emitting diode. PD is an abbreviation for photodetector or photodiode. A diaphragm member 37 is provided so as to cover the LED 32 and the PDs 35 and 36 and has openings 40, 41, and 45 for narrowing and restricting beam paths.

Light emitted from the LED 32 passes through the opening 41 and is irradiated onto a detection region 51 set on the intermediate transfer belt 20. The PD 35 is arranged so as to primarily receive light (specularly reflected light 60) that has been specularly reflected off of a detection region 50 and has passed through the opening 45. The PD 36 is arranged so as to primarily receive light (diffusely reflected light 61) that has been diffusely reflected off of the detection region 51 and has passed through the opening 45. Light emitted from the LED 32 and that passed through the opening 40 is irradiated to the detection region 50 set on the intermediate transfer belt 20.

A pattern position Pos_a is a position in the main scanning direction corresponding to the detection region 50 (reflection position) of the intermediate transfer belt 20. A pattern position Pos_b is a position in the main scanning direction corresponding to the detection region 51 (reflection position). Each pattern P included in a pattern group PG for detecting color misregistration is formed so as to extend over the pattern position Pos_a and the pattern position Pos_b. A single pattern P is composed of a sub-pattern Pa and a sub-pattern Pb. When the sub-pattern Pa passes through the detection region 50, the amount of light received by the PD 35 (an output signal level) changes. The control unit 10 measures the time during which the amount of received specularly reflected light 60 is changed (the time of passage of the sub-pattern Pa) and obtains the midpoint of the time of passage as the detection timing of the sub-pattern Pa. When the sub-pattern Pb passes the detection region 51, the amount of light received by the PD 36 (an output signal level) changes. The control unit 10 measures the time during which the amount of received diffusely reflected light 61 is changed (the time of passage of the sub-pattern Pb) and obtains the midpoint of the time of passage as the detection timing of the sub-pattern Pb.

The control unit 10 needs the amount of light received by the PD 35 and the amount of light received by the PD 36 to correct color misregistration and density. The PD 35 is provided at a position where the specularly reflected light 60 from the detection region 50 can be received, but light diffusely reflected off of the intermediate transfer belt 20 (or a toner image formed thereon) also becomes incident on the PD 35. That is, the amount of light received by the PD 35 also includes a diffusely reflected light component. Therefore, the control unit 10 reduces the diffusely reflected light component included in the amount of light received by the PD 35 based on the amount of diffusely reflected light received by the PD 36. Thus, the density of a toner image can be accurately detected.

Pattern Group PG for Detecting Color Misregistration

Figure 4:
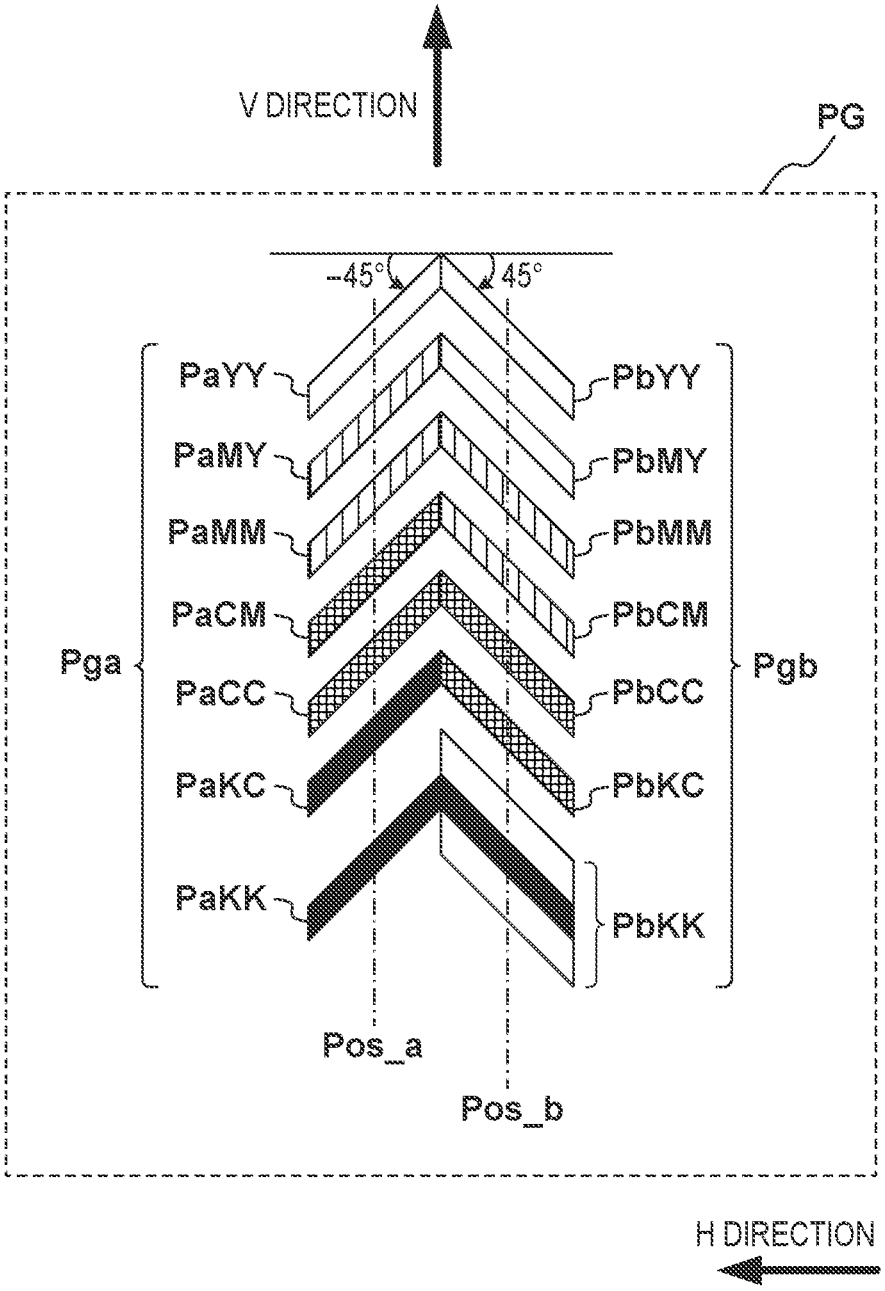
FIG. 4 is a diagram for explaining a group of patterns.

FIG. 4 illustrates a pattern group PG for detecting color misregistration. The pattern group PG has a first sub-pattern group Pga and a second sub-pattern group Pgb. The sub-pattern group Pga has a plurality of sub-patterns Pa that are each linear. The sub-pattern group Pgb has a plurality of sub-patterns Pb that are each linear. A sub-pattern Pa and a sub-pattern Pb forming a single pattern P are linearly symmetrical with respect to the V direction and form a pair. Here, as illustrated in FIG. 4, patterns P are inverted V-shapes (chevrons). An inverted V-shape is simply referred to as a V-shape below.

The sub-patterns Pa are tilted by −45 degrees with respect to the H direction. The sub-patterns Pb are tilted by +45 degrees with respect to the H direction. That is, an angle formed by a sub-pattern Pa and a sub-pattern Pb is 90 degrees. However, this angle is only an example and may be another angle. The shapes of the patterns P need not be V-shaped; it is sufficient so long as the sub-patterns Pa and the sub-patterns Pb are linearly symmetrical with respect to the V direction. It is not essential that the sub-patterns Pa and the sub-patterns Pb are connected; the sub-patterns Pa and the sub-patterns Pb may be apart. Further, the sub-patterns Pa and the sub-patterns Pb may overlap in the vicinity of connecting portions.

As illustrated in FIG. 4, a sub-pattern is denoted as "PxAB". Here, "x" is "a" or "b", and "A" and "B" are any of Y, M, C, and K. When x is "a", it indicates that the sub-pattern belongs to the sub-pattern group Pga. When x is "b", it indicates that the sub-pattern belongs to the sub-pattern group Pgb. A indicates the color of the sub-pattern Pa. B indicates the color of the sub-pattern Pb. For example, a sub-pattern PaKC refers to a black sub-pattern Pa belonging to the sub-pattern group Pga and indicates that the color of the sub-pattern Pb paired with this sub-pattern Pa is cyan. A sub-pattern PbCM refers to a magenta sub-pattern Pb belonging to the sub-pattern group Pgb and indicates that the color of the sub-pattern Pa paired with this sub-pattern Pb is cyan.

Each of the sub-patterns Pa belonging to the sub-pattern group Pga is formed so as to extend over the pattern position Pos_a. The sub-patterns Pb belonging to the sub-pattern group Pgb are formed so as to extend over the pattern position Pos_b. The PD 35 receives the specularly reflected light 60 that is reflected off of the detection region 50 through which the sub-patterns Pa belonging to the sub-pattern group Pga pass. The PD 36 receives the diffusely reflected light 61 that is reflected off of the detection region 51 through which the sub-patterns Pb belonging to the sub-pattern group Pgb pass. Here, the amount of light diffusely reflected off of the surface of the intermediate transfer belt 20 and black (achromatic) toner patterns is relatively small. Therefore, a sub-pattern PbKK is formed on a yellow (chromatic) toner pattern (background image). The light diffusely reflected off of yellow toner patterns is stronger than the light diffusely reflected off of black toner patterns. Therefore, the amount of light received by the PD 36 increases due to a preceding yellow toner pattern, decreases due to a black toner pattern, and then increases again due to a subsequent yellow toner pattern. The control unit 10 detects the sub-pattern PbKK by measuring the time during which this amount of received light has fallen below a threshold.

Figure 5A:
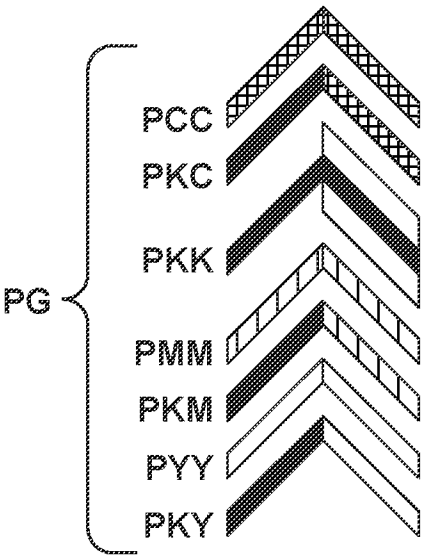
FIGS. 5A to 5E are diagrams for explaining a group of patterns.
Figure 5B:
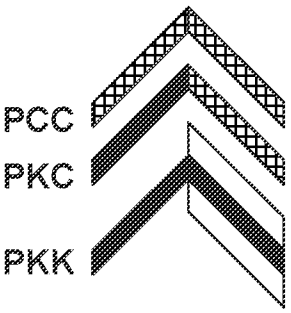
Figure 5C:
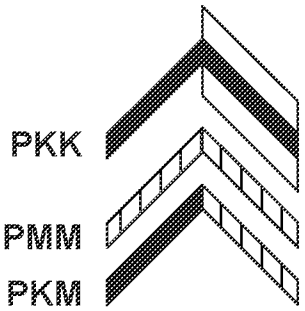
Figure 5D:
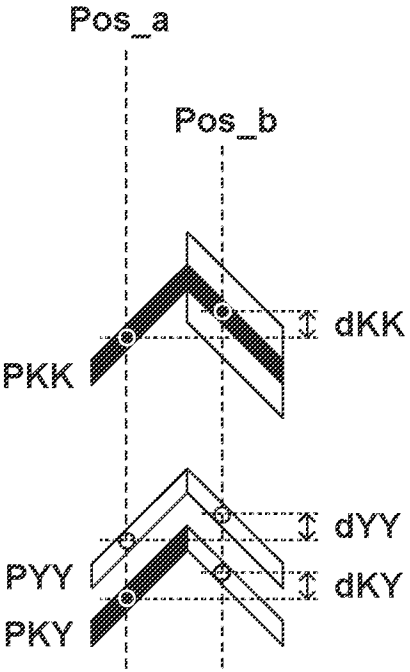

FIG. 5A illustrates a pattern group PG consisting of seven basic patterns P. FIG. 5B illustrates three basic patterns used to detect the amount of color misregistration between black and cyan. FIG. 5C illustrates three basic patterns used to detect the amount of color misregistration between black and magenta. FIG. 5D illustrates three basic patterns used to detect the amount of color misregistration between black and yellow. In this way, the amount of color misregistration of other colors with respect to black (reference color) is obtained. The optical sensor 30 detects light specularly reflected off of patterns passing through the pattern position Pos_a. Furthermore, the optical sensor 30 detects light diffusely reflected off of patterns passing through the pattern position Pos_b. Note that a toner pattern of another chromatic color is formed as a background image of a black pattern passing through the pattern position Pos_b.

In FIG. 5A to FIG. 5D, the identification information of a pattern P is denoted as "PAB". A indicates the color of the sub-pattern Pa. B indicates the color of the sub-pattern Pb. For example, a pattern PKC consists of a black sub-pattern Pa and a cyan sub-pattern Pb. As illustrated in FIG. 5B to FIG. 5D, the amount of color misregistration of a detection target color Z is detected using three patterns. Z is either Y, M, or C. A first is a pattern PZZ composed of only the detection target color. A second is a pattern PKK composed of only black, which is the reference color. A third is a pattern PKZ composed of only the detection target color Z and black.

As illustrated in FIG. 5D, the control unit 10 detects the amount of misregistration in the V direction of a sub-pattern Pb with respect to a sub-pattern Pa in one pattern P based on detection results of a pattern group PG. The sub-pattern Pb may be misregistered in the −V direction with respect to the sub-pattern Pa. In this case, a misregistration amount d is a positive value. Conversely, the sub-pattern Pb may be misregistered in the +V direction with respect to the sub-pattern Pa. In this case, the misregistration amount d is a negative value.

As illustrated in FIG. 5D, the control unit 10 obtains a misregistration amount dKK of a sub-pattern PbKK with respect to a sub-pattern PaKK in a pattern PKK. Furthermore, the control unit 10 obtains a misregistration amount dYY of a sub-pattern PbYY with respect to a sub-pattern PaYY in the pattern PYY. Furthermore, the control unit 10 obtains a misregistration amount dKY of a sub-pattern PbKY with respect to a sub-pattern PaKY in a pattern PKY.

The control unit 10 obtains a color misregistration amount LbKY in the pattern position Pos_b and a color misregistration amount LaKY in the pattern position Pos_a based on the three misregistration amounts, dKK, dYY, and dKY.

$$LaKY=dKY-dYY \tag{1}$$

$$LbKY=dKY-dKK \tag{2}$$

The control unit 10 obtains a misregistration amount LsKY in the main scanning direction and a misregistration amount LpKY in the sub-scanning direction.

$$LsKY=(LaKY-LbKY)/2 \tag{3}$$

$$LpKY=(LaKY+LbKY)/2 \tag{4}$$

Incidentally, although the color misregistration amount of yellow is obtained here, by changing Y in the above equation to C or M, the color misregistration amount of magenta and the color misregistration amount of cyan can each be calculated.

If the color misregistration amount d in FIG. 5D is 0, even if the pattern position Pos_b and the pattern position Pos_a are not in the center of the corresponding sub-patterns, LaKY, LbKY, LsKY, and LpKY all become 0. However, when periodic dynamic misregistration occurs in the sub-scanning direction, a detection error occurs. In the following, periodic misregistration will be described in detail.

The image forming apparatus 100 includes many rotating members and motors, gears, and the like for driving the rotating members. Since the rotation periods of the rotating members are not uniform, dynamic misregistration of transfer positions (image forming positions) occurs. The non-uniformity of the rotation periods occurs due to the eccentricity of the rotating members (e.g., the driving rollers of the intermediate transfer belt 20 and the photosensitive body 1), the eccentricity of the gears for driving the rotating members, the variation in the film thickness of the intermediate transfer belt 20, and the like.

The image forming apparatus 100 forms a pattern group PG at a position on the intermediate transfer belt 20 where the non-uniformity of the rotation periods is canceled, thereby reducing dynamic color misregistration. However, in order to cancel all of the plurality of rotation period components and its higher-order periodic components, the total length of the pattern PG becomes longer. Therefore, when measuring a color misregistration amount, the control unit 10 measures the reference color and the comparison color at a closest possible timing. Specifically, the control unit 10 reduces the difference between the phase in which the reference color is arranged and the phase in which the comparison color is arranged with respect to a rotation period. In short, the distance between the pattern P of the reference color and the pattern P of the comparison color is set to be shorter. Therefore, if the pattern position Pos_a and the pattern position Pos_b are at the nominal position, there will hardly be any dynamic detection error in the amount of color misregistration between the reference color and the comparison color. On the other hand, if the pattern position Pos_a and the pattern position Pos_b are misaligned from the nominal position, a detection error occurs.

Figure 5E:
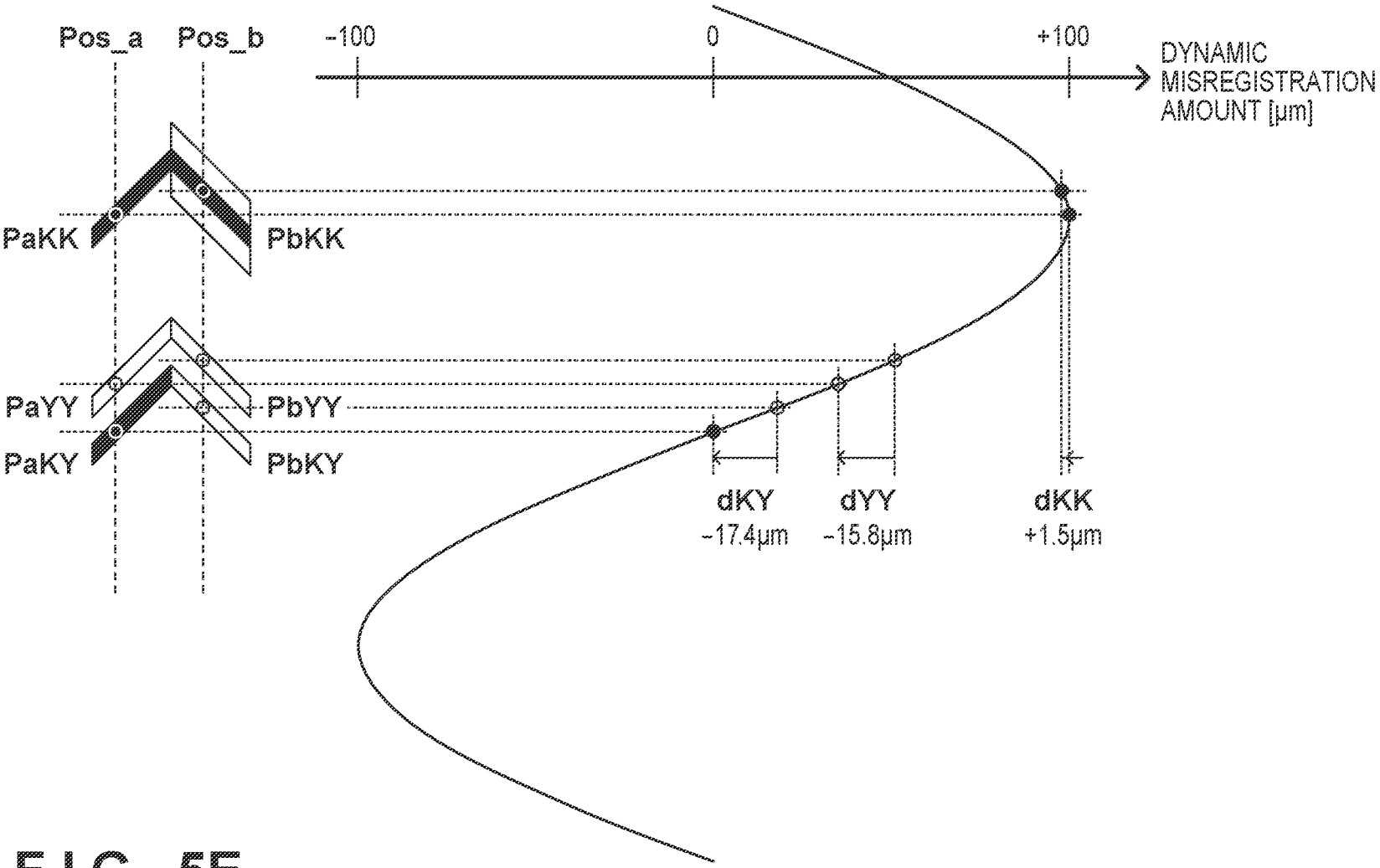

FIG. 5E simply exemplifies a case where there is dynamic misregistration at a pattern position Pos in a single rotation period with an amplitude of ±100 μm. In this case, there is a detection error of +1.5 μm in the misregistration amount dKK of the sub-pattern PbKK with respect to the sub-pattern PaKK. There is a detection error of −15.8 μm in the misregistration amount dYY. There is a detection error of −17.4 μm in the misregistration amount dKY. This detection error varies depending on which phase of the rotation period a pattern P is located.

Figure 6A:
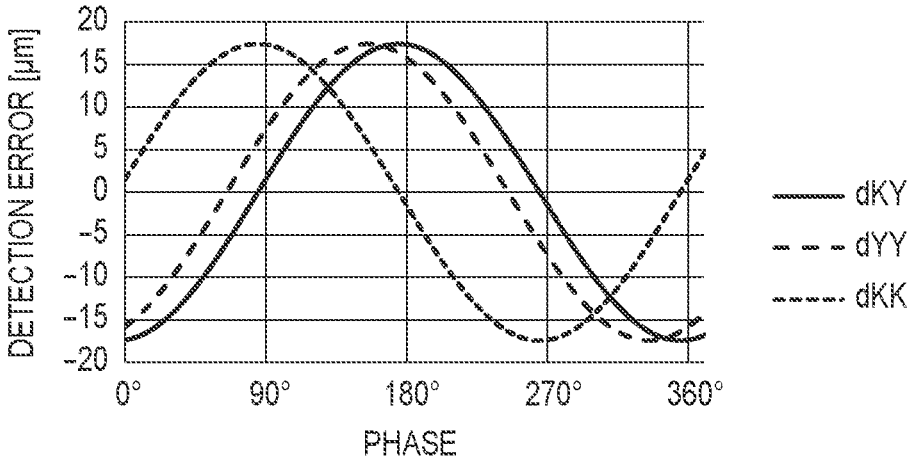
FIGS. 6A to 6C are diagrams for explaining a detection error.
Figure 6B:
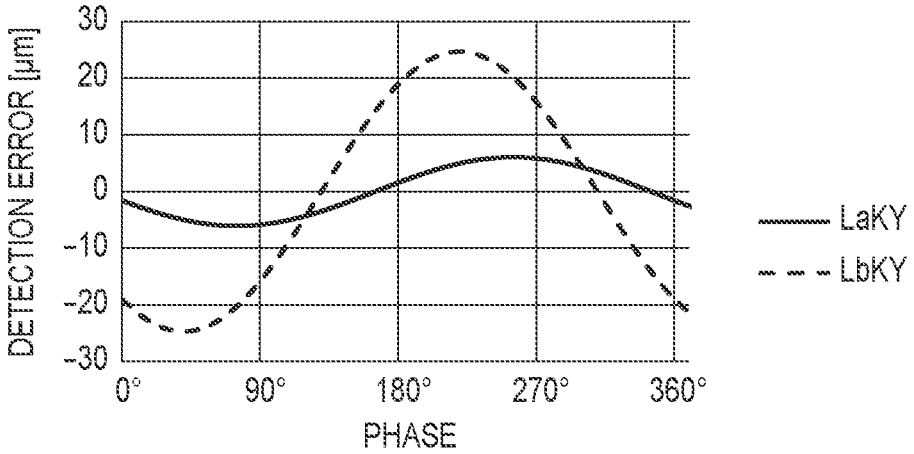
Figure 6C:
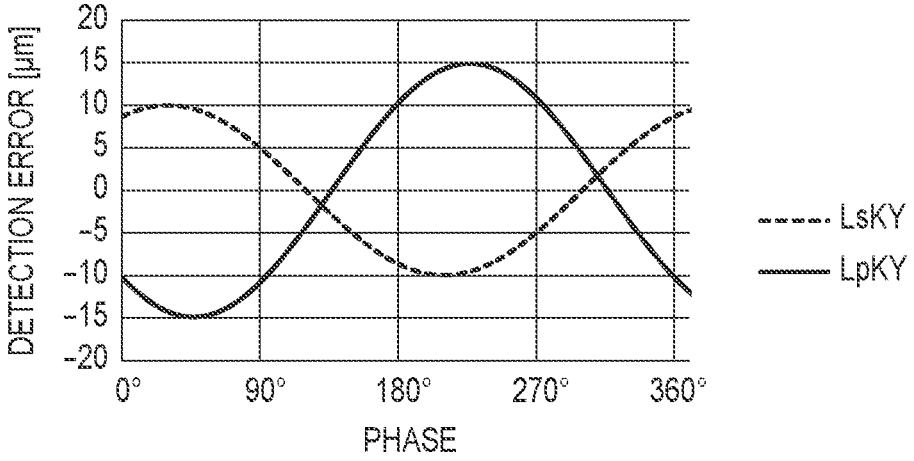

FIG. 6A illustrates the transition of detection errors in the misregistration amounts dKY, dYY, and dKK when the phase at which the pattern PaKY is detected is 0°. FIG. 6B illustrates the misregistration amounts LaKY and LbKY calculated based on the misregistration amounts dKY, dYY, and dKK. FIG. 6C illustrates the misregistration amounts LsKY and LpKY calculated based on the misregistration amounts LaKY and LbKY. The maximum value of the detection error in the misregistration amount LsKY in the main scanning direction is 10.0 μm. The maximum value of the detection error in the misregistration amount LpKY in the sub-scanning direction is 14.9 μm. As illustrated in FIG. 5D, since the pattern PKK is arranged to be distanced from the pattern PKY in the sub-scanning direction, the detection error is increased.

Figure 7A:
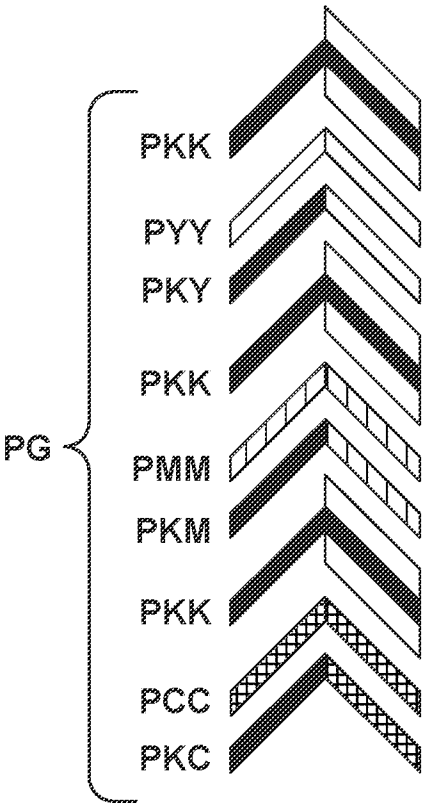
FIGS. 7A to 7E are diagrams for explaining a group of patterns.
Figure 7B:
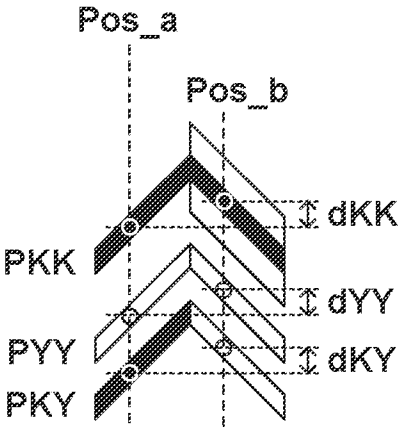
Figure 7C:
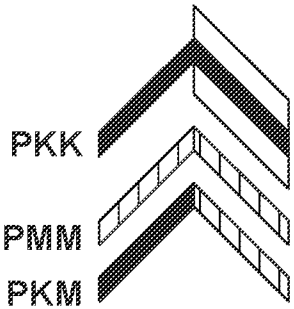
Figure 7D:
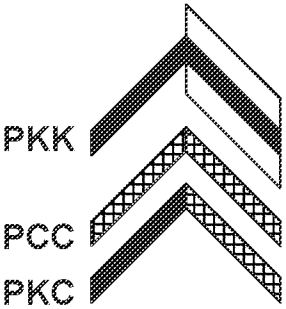

FIG. 7A illustrates another pattern group PG. In particular, two reference color patterns PKK have been added, reducing the distance between the reference color patterns and the comparison color patterns. FIG. 7B illustrates three basic patterns used to detect the amount of color misregistration between black and yellow. FIG. 7C illustrates three basic patterns used to detect the amount of color misregistration between black and magenta. FIG. 7D illustrates three basic patterns used to detect the amount of color misregistration between black and cyan. As illustrated in FIG. 7B, the misregistration amounts dKK, dKY, and dYY are detected as in FIG. 5D. The control unit 10 calculates LaKY, LbKY, LsKY, and LpKY in the same manner.

Figure 7E:
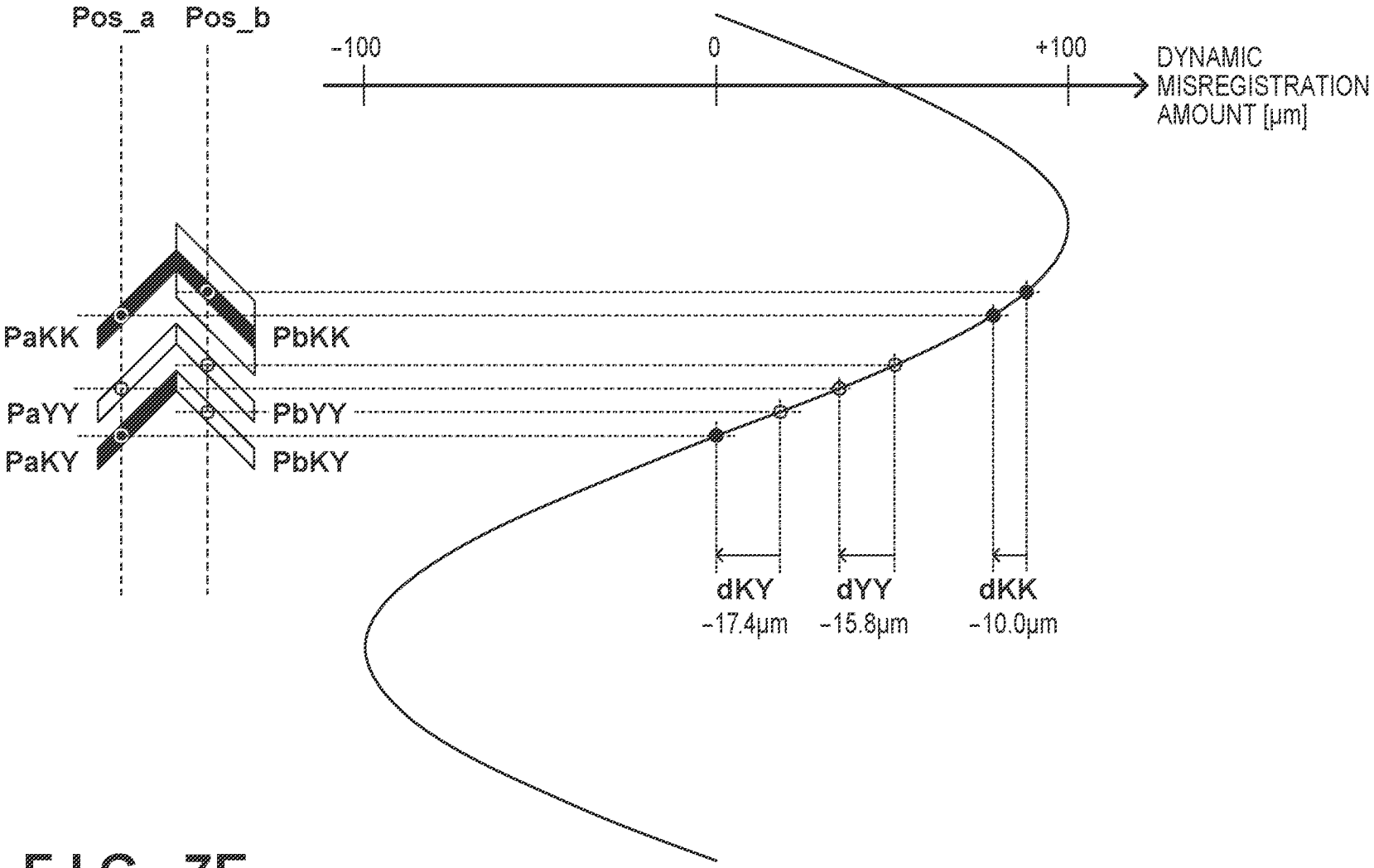

FIG. 7E illustrates detection errors for when the pattern positions Pos_a and Pos_b are misaligned from the nominal position. In this case, there is a detection error of −10.0 μm in the misregistration amount dKK of the sub-pattern PbKK with respect to the sub-pattern PaKK. There is a detection error of −15.8 μm in the misregistration amount dYY. There is a detection error of −17.4 μm in dKY.

Figure 8A:
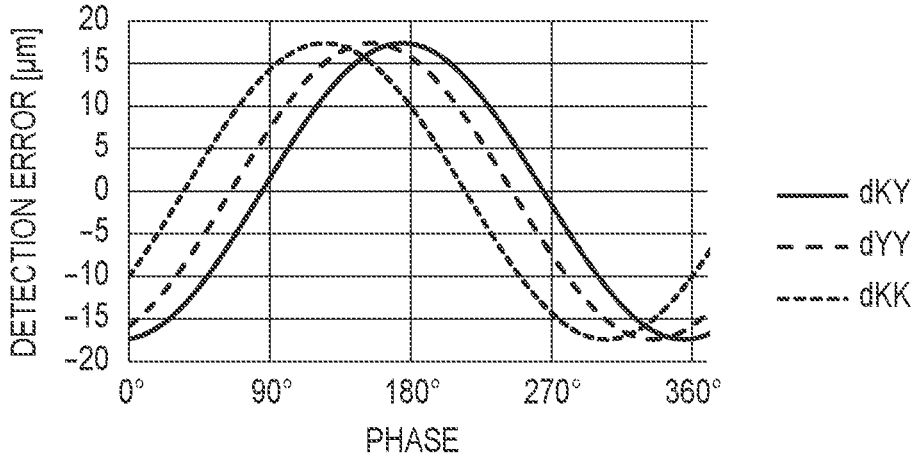
FIGS. 8A to 8C are diagrams for explaining a detection error.
Figure 8B:
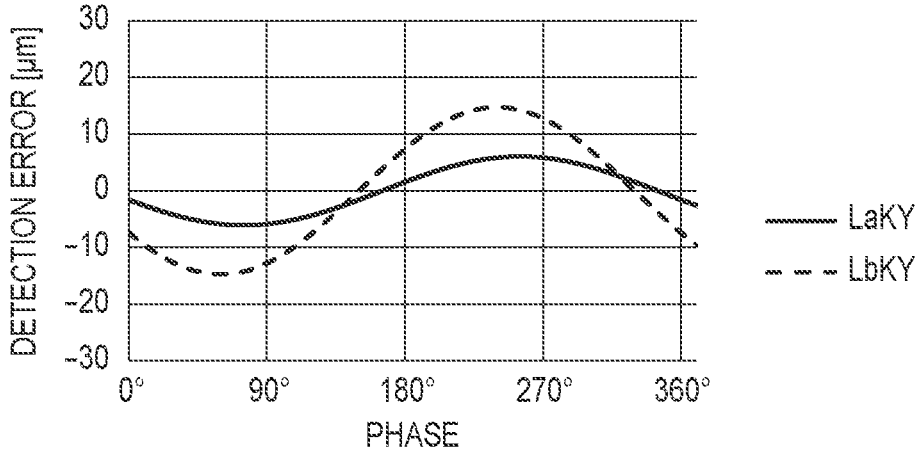
Figure 8C:
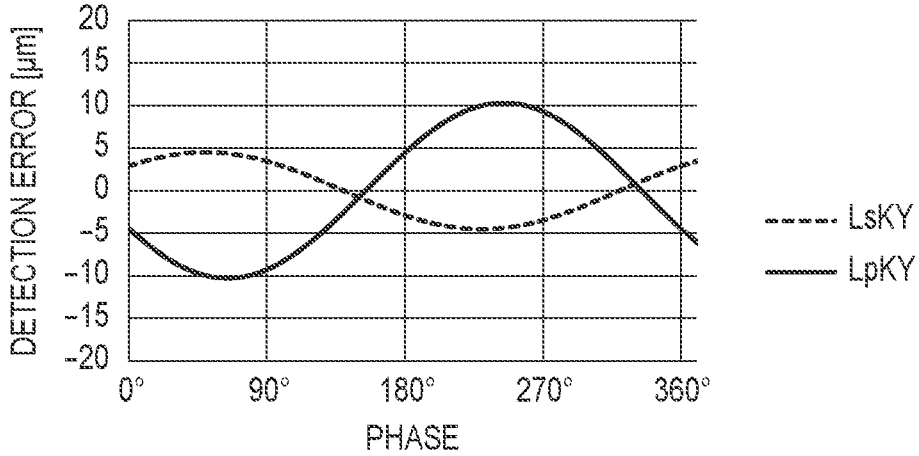

FIG. 8A illustrates the transition of detection errors in the misregistration amounts dKY, dYY, and dKK when the phase at which PaKY is detected is 0°. FIG. 8B illustrates LaKY and LbKY calculated based on the misregistration amounts dKY, dYY, and dKK. FIG. 8C illustrates LaKY and LbKY calculated based on LsKY and LpKY. The maximum value of the detection error in the misregistration amount LsKY in the main scanning direction is 4.5 μm. The maximum value of the detection error in the misregistration amount LpKY in the sub-scanning direction is 10.3 μm. This indicates that the effect of detection errors is reduced by the pattern PKK and the pattern PKY being arranged relatively closer to each other.

As described above, by configuring a pattern group PG with nine patterns P, the effect of the detection errors is reduced. However, since two patterns PKK are added, the total length of the pattern group PG in the V direction becomes longer. In addition, the sub-pattern PbKK constituting the pattern PKK is detected using diffusely reflected light. Therefore, the sub-pattern PbKK requires a yellow (chromatic) background image. This means that more toner is consumed for color misregistration detection. Further, a background image increases the total length of the pattern group PG. When the total length of the pattern group PG is increased, the degree of freedom for arranging the pattern group PG in a position for cancelling the non-uniformity of the rotation periods becomes reduced.

Figure 9A:
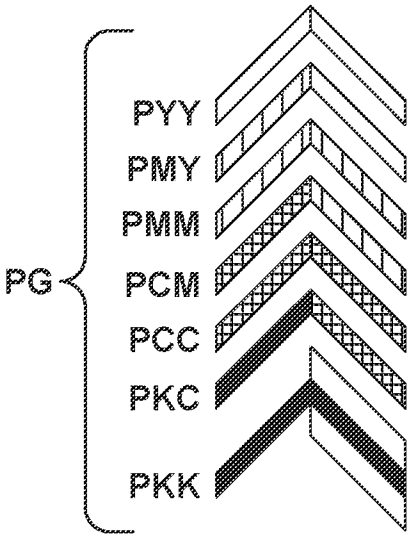
FIGS. 9A to 9E are diagrams for explaining a group of patterns.

FIG. 9A illustrates a further-improved pattern group PG. This pattern group PG does not have a concept of a reference color. The color misregistration amount of the detection target color is obtained from a pattern composed of only a first color, a pattern composed of only a second color different from the first color, and a pattern composed of the first color and the second color. In the V direction, a pattern of only the first color, a pattern of the first color and the second color, and a pattern of only the second color are arranged in order.

Figure 9B:
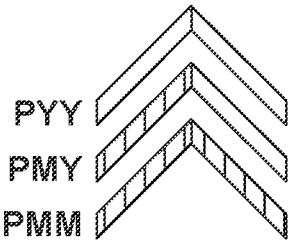
Figure 9C:
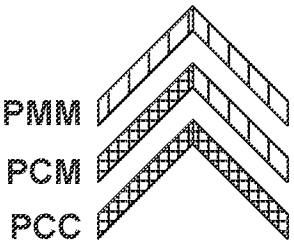
Figure 9D:
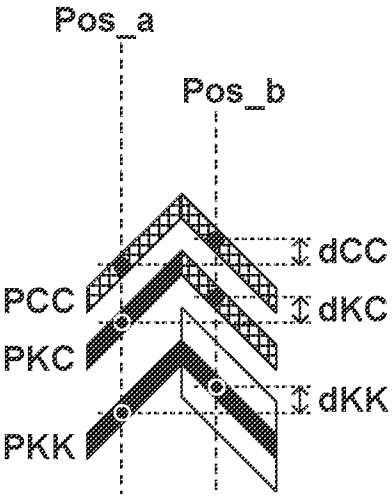

FIG. 9B shows three patterns for obtaining the amount of color misregistration of magenta with respect to yellow. That is, the misregistration amounts dYY, dMY, and dMM are obtained. FIG. 9C shows three patterns for obtaining the amount of color misregistration of cyan with respect to magenta. That is, the misregistration amounts dMM, dCM, and dCC are obtained. FIG. 9D shows three patterns for obtaining the amount of color misregistration of black with respect to cyan. That is, the misregistration amounts dCC, dKC, and dKK are obtained. These are all applied to Equation (1) to Equation (4) and are utilized for calculating the amount of color misregistration.

As illustrated in FIG. 9A, this pattern group PG is composed of seven patterns P. In seven patterns P, yellow, magenta, and cyan, which are chromatic colors, are mutually replaceable, and this replacement does not affect the accuracy of detection of the amount of color misregistration.

Figure 9E:
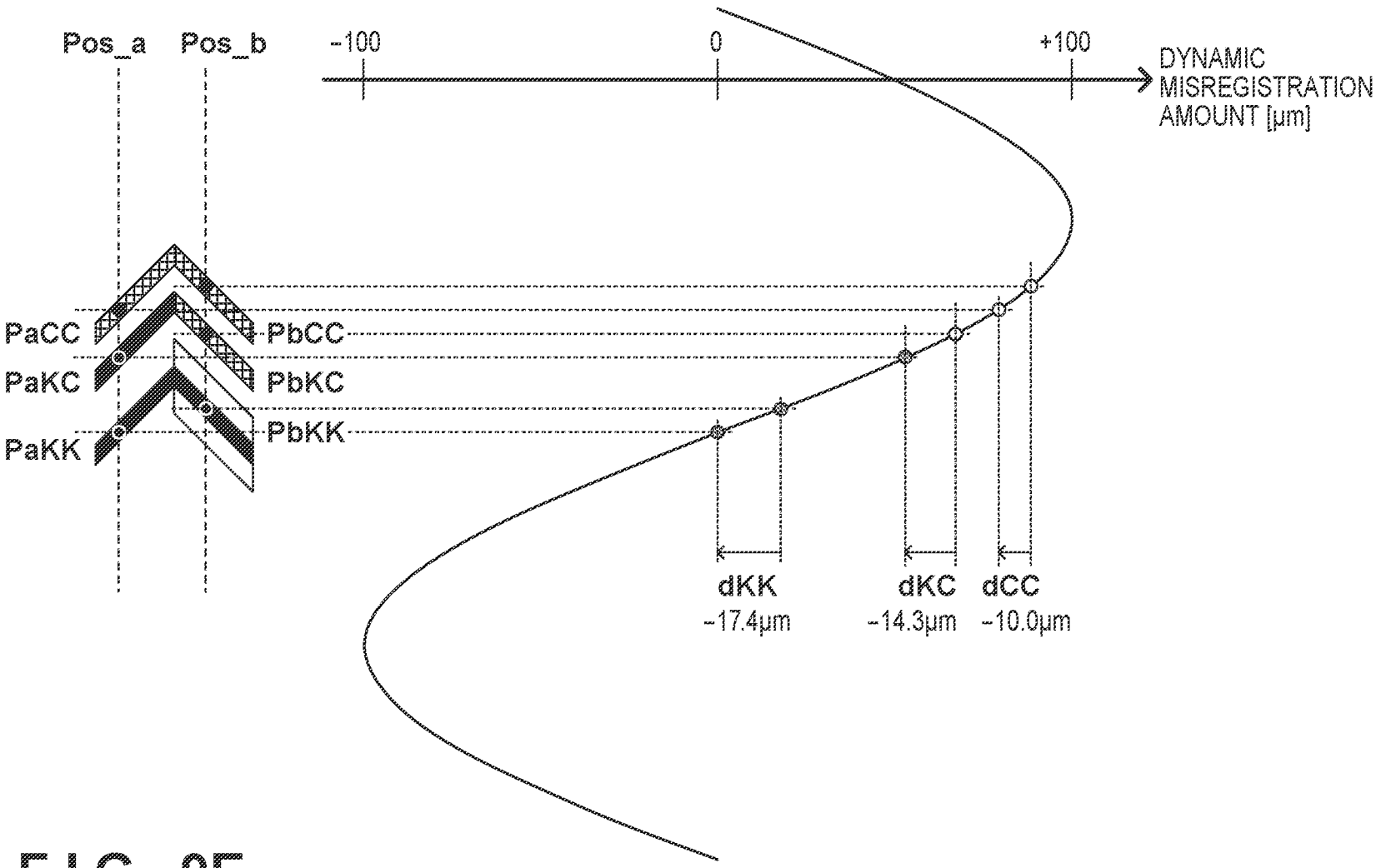

FIG. 9E illustrates detection errors for when the pattern positions Pos_a and Pos_b are misaligned from the nominal position. In this case, there is a detection error of −17.4 μm in the misregistration amount dKK of the sub-pattern PbKK with respect to the sub-pattern PaKK. The detection error in dKC is −14.3 μm. The detection error in dCC is −10.0 μm. This detection error depends on which phase of the rotation period the pattern P is located.

Figure 10A:
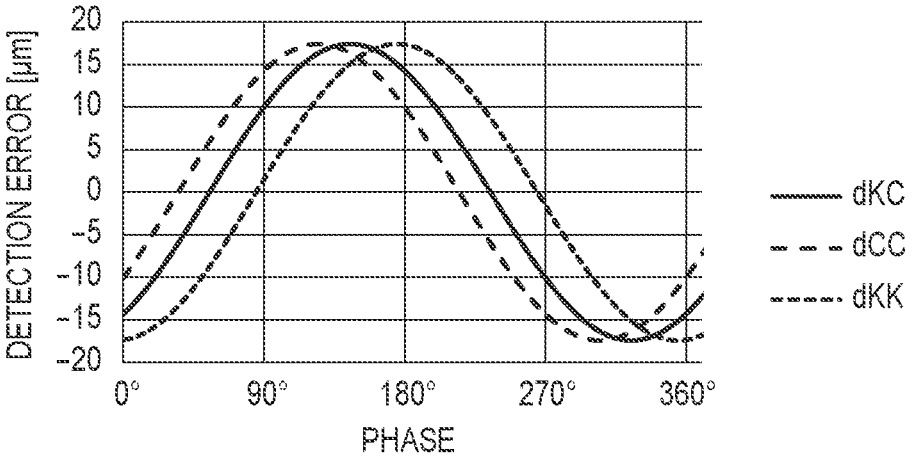
FIGS. 10A to 10C are diagrams for explaining a detection error.
Figure 10B:
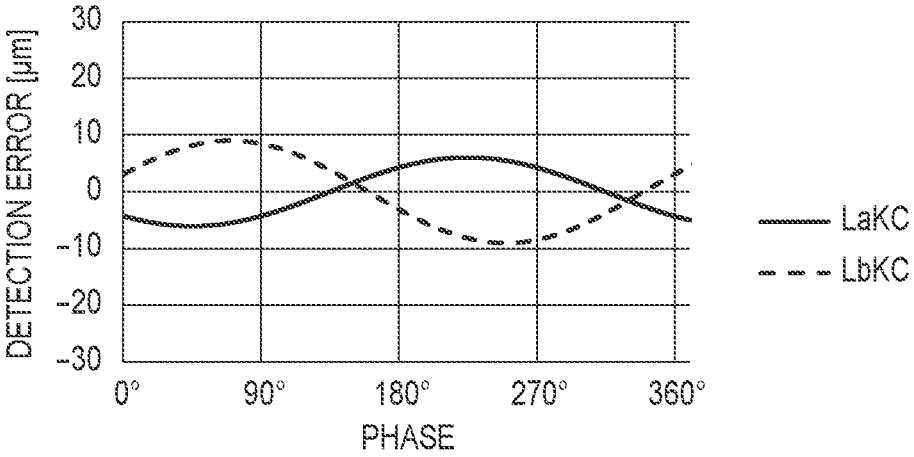
Figure 10C:
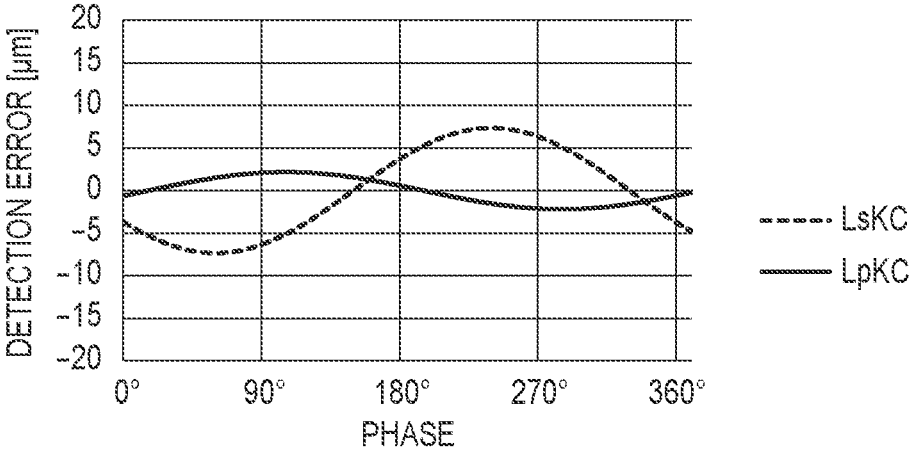

FIG. 10A illustrates the transition of detection errors in dKC, dCC, and dKK when the phase at which the sub-pattern PaKK is detected is 0°. FIG. 10B illustrates the misregistration amounts LaKC and LbKC calculated based on the misregistration amounts dKC, dCC, and dKK. FIG. 10C illustrates the misregistration amounts LsKC and LpKC calculated based on the misregistration amounts LaKC and LbKC. The maximum value of the detection error in LsKY is 7.4 μm. The maximum value of the detection error in LpKY is 2.2 μm. The detection errors of the pattern group PG illustrated in FIG. 9A are less than the detection errors of the pattern group illustrated in FIG. 5A. In particular, the detection error in the misregistration amount in the sub-scanning direction is greatly reduced. As illustrated in FIG. 9A, this pattern group PG is composed of seven patterns P.

The total length of the pattern group PG illustrated in FIG. 9A is shorter than the total length of the pattern group illustrated in FIG. 7A. Thus, even if the number of patterns P is not increased, the detection error in the amount of color misregistration is reduced by devising the combination of two colors for obtaining the amount of color misregistration and the order of the patterns.

As illustrated in FIG. 2, two optical sensors 30*a* and 30*b* may be provided above the intermediate transfer belt 20, each near an end portion in the main scanning direction. Further, a pattern group PG may be formed at each of both end portions of the intermediate transfer belt 20. Based on the detection results of the optical sensors 30*a* and 30*b*, the control unit 10 can calculate a misregistration amount Ls of a write start position in the main scanning direction, a misregistration amount of the length (magnification) of an image in the main scanning direction, a misregistration amount Lp of the write start position in the sub-scanning direction, and a misregistration amount of the tilt of the image in the sub-scanning direction. Since methods for calculating these are known, they will not be described in detail here.

In FIG. 9A, the patterns P are formed in the order of yellow, magenta, cyan, and black in the pattern group PG. However, this order of colors is not essential and order of colors different from this may be employed. For example, a pattern P of only the first color is arranged first in the V direction. A pattern P of the first color and the second color is arranged second. A pattern P of only the second color is arranged third. A pattern P of the second color and the third color is arranged fourth. A pattern P of only the third color is arranged fifth. A pattern P of the third color and the fourth color is arranged sixth. A pattern P of only the fourth color is arranged seventh.

The optical sensor 30 detects the sub-patterns Pa with specularly reflected light and detects the sub-patterns Pb with scatteringly reflected light. Therefore, when the sub-pattern Pb is black, a chromatic background image becomes necessary. However, the color of the background image may be any of yellow, magenta, and cyan. For example, the control unit 10 may examine the remaining amount of yellow, magenta, and cyan and form a background image with toner of a color having a larger remaining amount.

The optical sensor 30 may be replaced with another optical sensor that detects the sub-patterns Pa with specularly reflected light and also detects the sub-patterns Pb with specularly reflected light. In this case, the background image is not necessary.

In order to detect the amount of color misregistration in the main scanning direction and the amount of color misregistration in the sub-scanning direction, a V-shaped pattern P is adopted, but this is only an example. When detecting the color misregistration amount only in the sub-scanning direction, the patterns P may be patterns of horizontal lines that are parallel to the main scanning direction.

Control Unit

Figure 11:
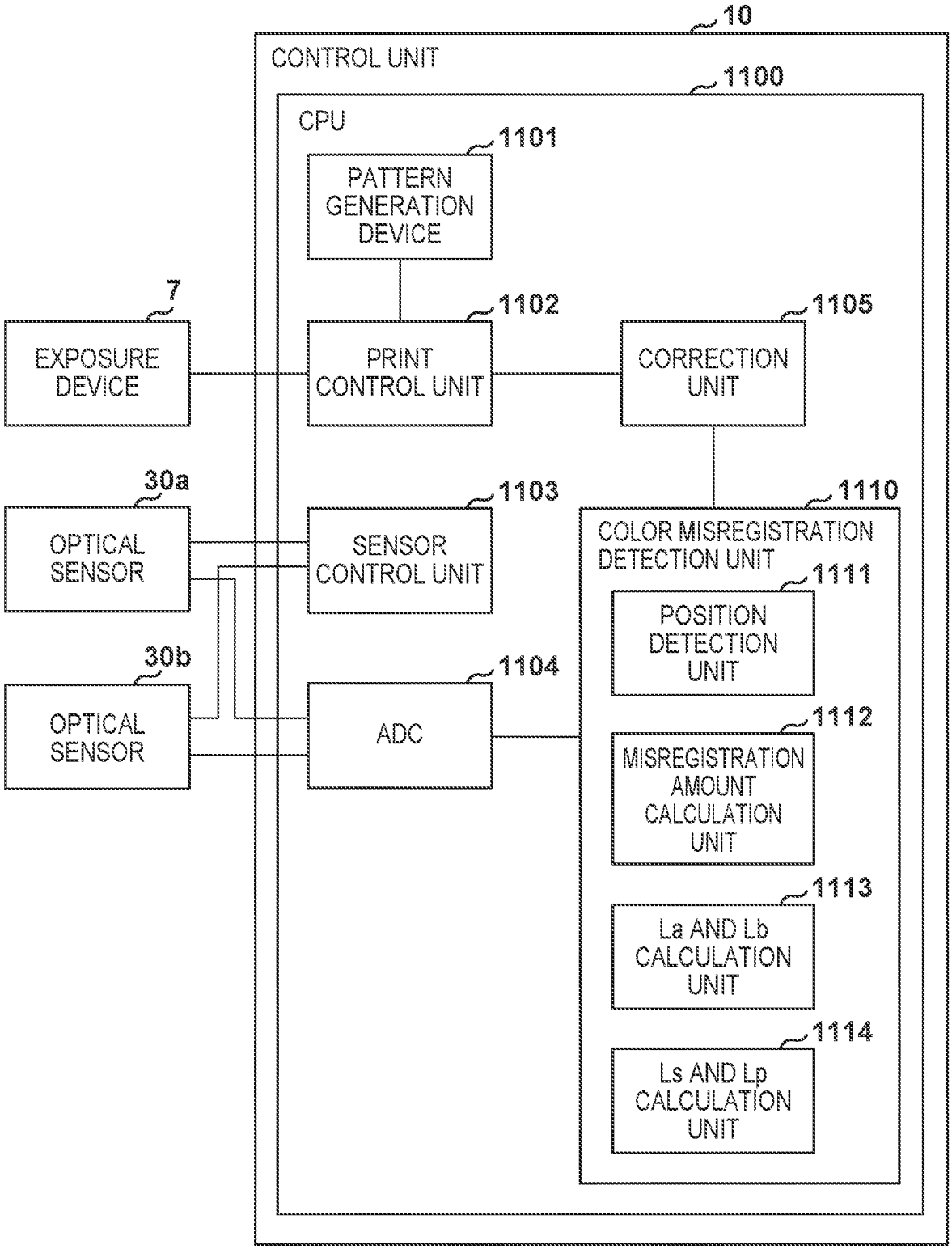
FIG. 11 is a diagram for explaining a control unit.

FIG. 11 illustrates the details of the control unit 10. A CPU 1100 realizes various functions by executing a control program. However, the functions may be implemented by a hardware circuit provided external to the CPU 1100.

A pattern generation device 1101 generates image data or an image signal for forming a pattern group PG and supplies it to a print control unit 1102. The print control unit 1102 controls image formation executed in the image forming apparatus 100. For example, the print control unit 1102 controls the charging device 2 to charge the photosensitive body 1 and supplies an image signal to the exposure device 7, thereby forming an electrostatic latent image on the photosensitive body 1. Here, the print control unit 1102 corrects a write start timing in the main scanning direction, a write start timing in the sub-scanning direction, and a magnification (adjusted by the image clock) in the main scanning direction in accordance with a correction amount specified by a correction unit 1105. In addition, an electrostatic latent image is individually formed for each of YMCK. The print control unit 1102 develops an electrostatic latent image by controlling the developing device 3 to form a toner image. The print control unit 1102 applies a transfer bias to the primary transfer roller 6 to transfer the toner image onto the intermediate transfer belt 20.

A sensor control unit 1103 controls the optical sensors 30*a* and 30*b* to detect the pattern group PG on the intermediate transfer belt 20. An ADC (analog-to-digital converter) 1104 converts detection signals (amounts of received light) outputted from the optical sensors 30*a* and 30*b* into digital values and passes them to a color misregistration detection unit 1110. However, this is just an example. The CPU 1100 is a kind of microcomputer and may be provided with a terminal having an input capture function. The input capture function is a function or circuit that counts time based on the rising edges or falling edges of signals to be inputted. In this case, the detection signals are inputted to this terminal, and the input capture function measures time based on the rising edges and falling edges of the detection signals. For example, the input capture function may measure the difference in time between the rising edge (falling edge) of one of the detection signals and the rising edge (falling edge) of another detection signal. Thus, the basic information of a color misregistration amount may be detected. The color misregistration detection unit 1110 obtains a color misregistration amount based on detection results of the optical sensors 30*a* and 30*b* and passes the color misregistration amount to the correction unit 1105. A position detection unit 1111 detects the passage timing of each of the sub-patterns Pa and Pb based on the detection results of the optical sensor 30*a* and 30*b*. The misregistration amount calculation unit 1112 calculates the misregistration amount d as a difference between the detection timing of a sub-pattern Pb and the detection timing of a sub-pattern Pa outputted from the position detection unit 1111. An La and Lb calculation unit 1113 calculates the misregistration amounts La and Lb of the pattern position Pos using three misregistration amounts d. Equations (1) and (2) are used for this. An Ls and Lp calculation unit 1114 calculates the color misregistration amounts Ls and Lp using the misregistration amounts La and Lb outputted from the La and Lb calculation unit 1113. Equations (3) and (4) are used for this. The correction unit 1105 determines the correction amount of a control parameter used in the print control unit 1102 based on the color misregistration amounts Ls and Lp and sets the correction amount to the print control unit 1102.

Flowchart

Figure 12:
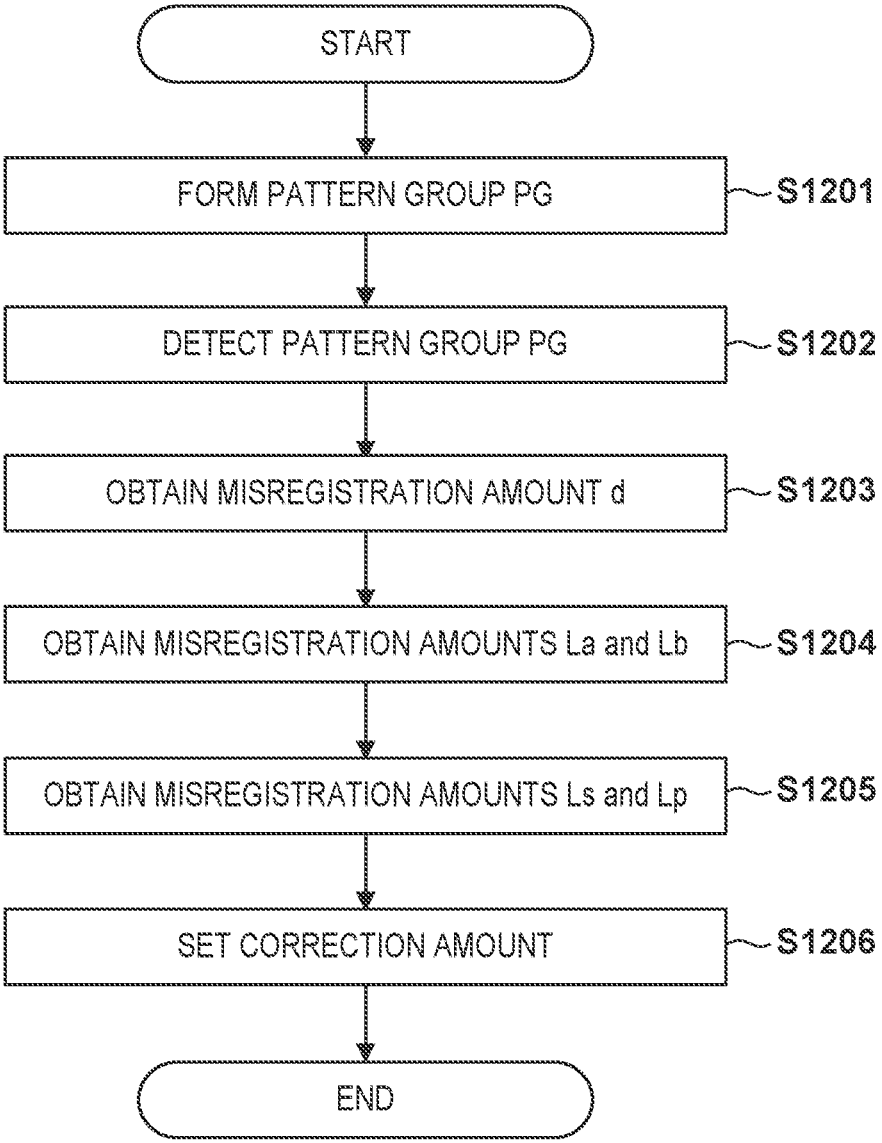
FIG. 12 is a flowchart indicating detection of color misregistration.

FIG. 12 shows a process executed by the CPU 1100 in accordance with a control program. The CPU 1100 starts the following process when a condition for executing detection of a color misregistration amount is met. The execution condition is, for example, that the image forming apparatus 100 is started, that the image forming apparatus 100 has continuously formed a predetermined number of images, that the temperature in the image forming apparatus 100 has greatly changed, or the like.

In step S1201, the CPU 1100 controls the image forming apparatus 100 to form a pattern group PG on the intermediate transfer belt 20. In step S1202, the CPU 1100 detects the pattern group PG using the optical sensor 30. In step S1203, the CPU 1100 obtains the misregistration amount d based on the detection result of the optical sensor 30. For example, as illustrated in FIG. 9D, the misregistration amounts dCC, dKC, and dKK are obtained for cyan and black.

In step S1204, the CPU 1100 calculates the misregistration amounts La and Lb based on the misregistration amount d. As illustrated in FIG. 9D, the misregistration amounts LaKC and LbKC are obtained for cyan and black. As illustrated in FIG. 9B, misregistration amounts are also obtained for yellow and magenta. As illustrated in FIG. 9C, misregistration amounts are also obtained for magenta and cyan. In step S1205, the CPU 1100 calculates the misregistration amounts La and Lb based on the misregistration amounts La and Lb. As illustrated in FIG. 9D, the misregistration amounts LsKC and LpKC are obtained for cyan and black. The misregistration amounts are also obtained for yellow and magenta. The misregistration amounts are also obtained for magenta and cyan. In step S1206, the CPU 1100 obtains a correction amount such as a write start position and an image clock based on the misregistration amounts LsKC and LpKC and sets the correction amount to the print control unit 1102.

Second Embodiment

Figure 13A:
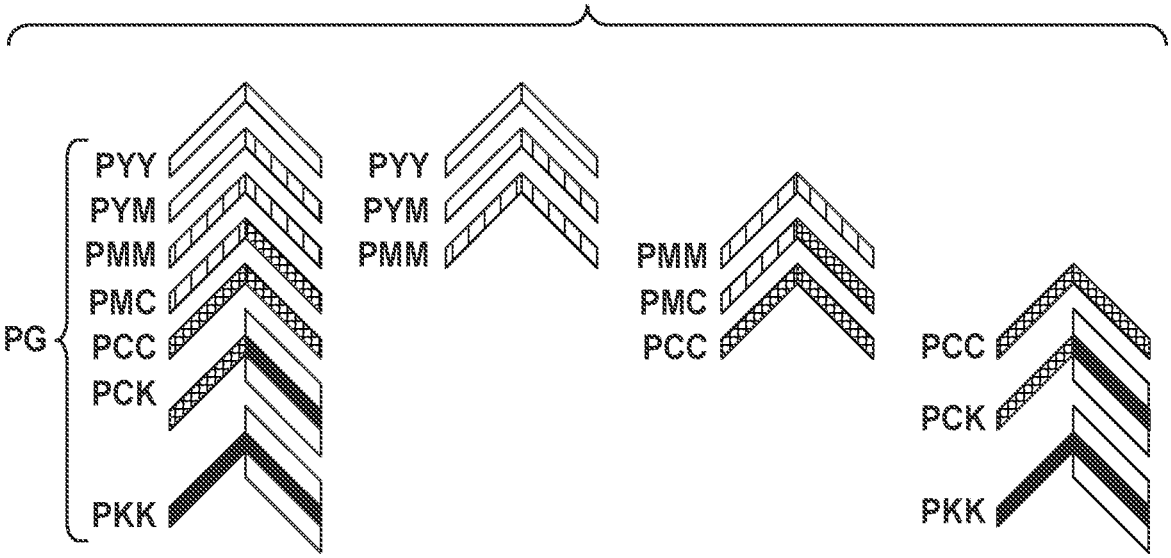
FIGS. 13A and 13B are diagrams for explaining a group of patterns.

FIG. 13A illustrates a pattern group PG of a second embodiment. Compared to the pattern group PG of the first embodiment illustrated in FIG. 9A, in the pattern group PG of the second embodiment, the colors of the sub-patterns Pa and the colors of the sub-patterns Pb have been switched. In addition, in the sixth pattern P from the top, the pattern PKC has been switched to the pattern PCK. That is, since the sub-pattern Pb has been made black, a chromatic background image has been added to the sub-pattern Pb. This is because the sub-pattern Pb is detected by the optical sensor 30 using the scatteringly reflected light. The chromatic color may be any of yellow, magenta, and cyan.

Here, although the colors of the sub-patterns Pa and the colors of the sub-patterns Pb for all of the seven patterns Pa have been switched, the colors of the sub-patterns Pa and the colors of the sub-patterns Pb only in some patterns P may be switched. For example, among the patterns PMY, PCM, and PKC, a switch may be performed for only one pattern, or a switch may be performed for only two patterns.

As illustrated in FIG. 13A, the total length of the pattern PG in the V direction becomes longer because a background image has been added to the sub-pattern PbCK of the pattern PCK. Especially, the pattern intervals increase between the patterns PCC, PCK, and PKK, and therefore, a dynamic detection error increases.

Figure 13B:
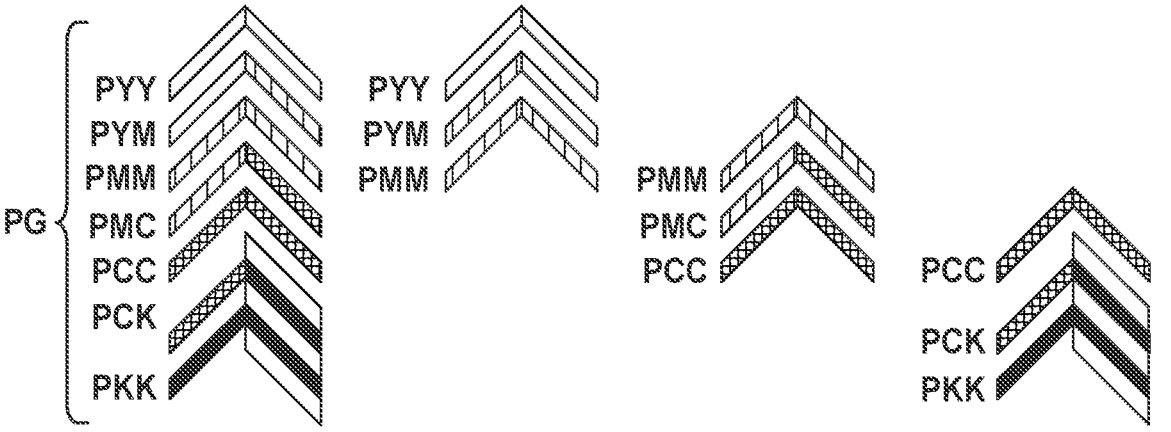

FIG. 13B illustrates a further-improved pattern group PG. In FIG. 13B, the distance between the pattern PCK and the pattern PKK, each having a background image, has been reduced. In particular, the background image of the preceding pattern PCK and the background image of the subsequent pattern PKK are joined or overlapped.

Figure 14:
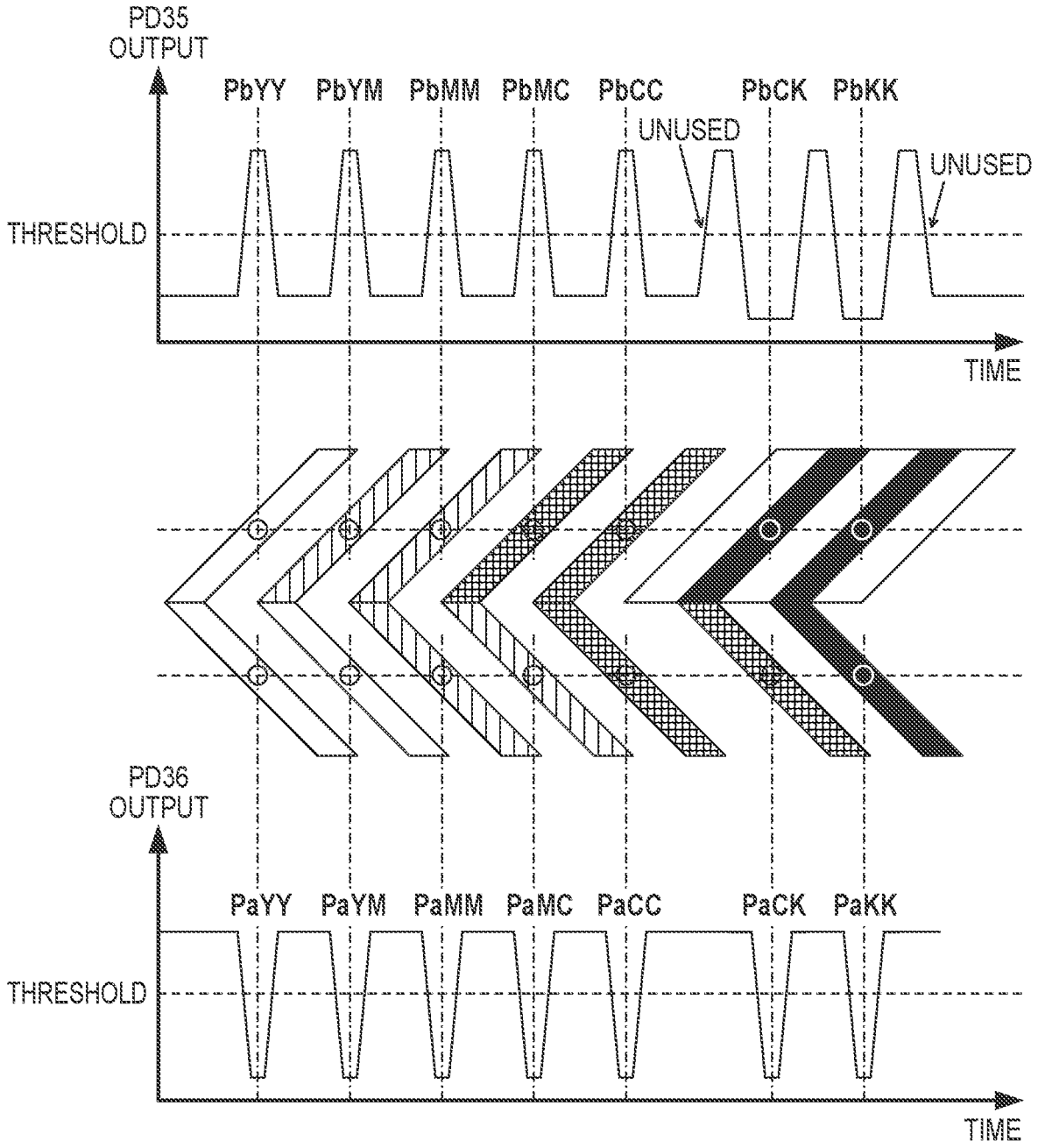
FIG. 14 is a diagram for explaining a method of detecting black patterns formed on a continuous background image.

FIG. 14 illustrates results of detecting the sub-patterns Pa and Pb for the improved pattern group PG. A yellow background image is formed for black sub-patterns Pb. Also, the background image of the preceding sub-pattern PbCK and the background image of the following sub-pattern PbKK are continuous. The PD 35 of the optical sensor 30 receives light specularly reflected off of the sub-patterns Pa belonging to the sub-pattern group Pga. The PD 36 receives light diffusely reflected off of the sub-patterns Pb belonging to the sub-pattern group Pgb.

With respect to the sub-pattern group Pgb, the amount of light diffusely reflected off of the surface of the intermediate transfer belt 20 and black (achromatic) toner is smaller. Therefore, there is a black sub-pattern Pb between the peak of light specularly reflected off of a yellow background image and the peak of light specularly reflected off of the next yellow background image. That is, there is a time that corresponds to the central position of black between the time of the peak of light specularly reflected off of a yellow background image and the time of the peak of light specularly reflected off of the next yellow background image. The position detection unit 1111 detects the positions (timings) of the black sub-patterns Pb using this.

As illustrated in FIG. 14, in order to detect the length of a sub-pattern, the output values of the PDs 35 and 36 are compared to a threshold value. Meanwhile, three peaks are generated by light specularly reflected off of a yellow pattern (background image). Of these, the rise of a first peak and the fall of a third peak are not utilized for detecting color misregistration. That is, the timing obtained by dividing the time from the timing at which the fall of the first peak becomes less than the threshold to the timing at which the rise of the second peak exceeds the threshold by 2 indicates the position of the sub-pattern PbCK. The timing obtained by dividing the time from the timing at which the fall of the second peak becomes less than the threshold to the timing at which the rise of the third peak exceeds the threshold by 2 indicates the position of the sub-pattern PbKK.

As described above, by forming the sub-pattern PbCK and a successive background image for PbKK with yellow toner, the black sub-patterns Pb can be detected by diffusely reflected light. Further, the increase in the total length of the pattern group PG is also reduced.

Technical Concept Derived from Embodiment

As illustrated in FIG. 1, the intermediate transfer belt 20 is an example of an image carrier. The photosensitive body 1 and the like function as an image forming unit (printer) that forms a test image group (e.g., a pattern PG) for obtaining the amount of color misregistration with respect to the image carrier, using toners of a plurality of different colors. The optical sensor 30 is an example of a detection unit (image sensor) that detects the test image group carried on the image carrier. As illustrated in FIG. 9A, the test image group includes test images formed at different positions in order in a moving direction (e.g., the V direction) of the image carrier. For example, the test image group includes a first test image (e.g., PYY), a second test image (e.g., PMY/PYM), a third test image (e.g., PMM), a fourth test image (e.g., PCM/PMC), and a fifth test image (e.g., PCC). Each test image includes two line segments formed at different positions in a width direction perpendicular to the moving direction (e.g., H direction). The first test image has one line segment (e.g., the sub-pattern PaYY) formed of toner of a first color (e.g., Y) and another line segment (e.g., PbYY) formed of toner of the first color. The second test image has one line segment (e.g., PaMY/PaYM) formed of toner of a second color (e.g., M) or the first color and another line segment (e.g., PbMY/PbYM) formed of toner of the first color or the second color. The second test image may have one line segment (e.g., PaMY) formed of toner of the second color (e.g., M) and another line segment (e.g., PbMY/PbYM) formed of toner of the first color. Alternatively, the second test image may have one line segment (e.g., PaYM) formed of toner of the first color and another line segment (e.g., PbYM) formed of toner of the second color. The third test image has one line segment (e.g., PaMM) formed of toner of the second color and another line segment (e.g., PbMM) formed of toner of the second color. The fourth test image has one line segment (e.g., PaCM/PaMC) formed of toner of third color (e.g., C) or the second color and another line segment (e.g., PbCM/PbMC) formed of toner of the second color or the third color. For example, the fourth test image has one line segment (e.g., PaCM) formed of toner of the third color (e.g., C) and another line segment (e.g., PbCM) formed of toner of the second color. Alternatively, the fourth test image may have one line segment (e.g., PaMC) formed of toner of the second color and another line segment (e.g., PbMC) formed of toner of the third color. The fifth test image has two line segments formed at different positions in the width direction, one line segment formed of toner of the third color (e.g., PaCC), and the other line segment formed of toner of the third color (e.g., PbCC). A detection unit (e.g., optical sensor 30) detects a position at which one line segment is formed and a position at which another line segment is formed for each of the first test image to the fifth test image. This provides a pattern group PG that is robust to an installation error of the optical sensor 30. That is, even when the installation error of the detection unit occurs, a test image group capable of suppressing a decrease in detection accuracy is provided.

The control unit 10, the CPU 1100, and the color misregistration detection unit 1110 are examples of acquisition units that acquire a color misregistration amount based on a detection result of the detection unit. The control unit 10, the CPU 1100 and the color misregistration detection unit 1110 may be referred to as processors or processing circuits. An acquisition unit (e.g., the control unit 10) obtains a color misregistration amount (e.g., d) based on a difference between the position at which one line segment is formed and the position at which another line segment is formed. The correction unit 1105 is an example of a correction unit (a processor or processing circuit) that corrects color misregistration of toner images based on the color misregistration amount. This makes it possible to accurately detect the amount of color misregistration. In addition, color misregistration is corrected with high accuracy.

As illustrated in FIG. 3 and the like, one line segment (e.g., a sub-pattern Pa) and another line segment (e.g., a sub-pattern Pb) for each of the first test image to the fifth test image are linearly symmetrical with respect to the moving direction. Thus, the amount of color misregistration in both the main scanning direction and the sub scanning direction can be detected. As illustrated in FIG. 4 and the like, one line segment and another line segment for each of the first test image to the fifth test image may be arranged in a V-shape.

As illustrated in FIG. 4B and the like, the LED 32 is an example of a light emitting unit that emits light toward the image carrier. The PD 35 is an example of a first light receiving unit that is provided so as to receive light emitted from the light emitting unit and specularly reflected off of one line segment. The PD 36 is an example of a second light receiving unit that is provided so as to receive light emitted from the light emitting unit and diffusely reflected off of another line segment.

As illustrated in FIG. 4B, FIG. 9A and the like, the test image group may further include a sixth test image (e.g., PKC) that is formed subsequently to the fifth test image in the moving direction and a seventh test image (e.g., PKK) that is formed subsequently to the sixth test image. The sixth test image has two line segments formed at different positions in the width direction, one line segment (e.g., PaKC) formed of toner of the fourth color and the other line segment (e.g., PbKC) formed of toner of the third color. The seventh test image has two line segments formed at different positions in the width direction, one line segment (e.g., PaKK) formed of toner of the fourth color and the other line segment (e.g., PbKK) formed of toner of the fourth color.

In the seventh test image, the other line segment is formed of toner of the fourth color that is achromatic on a background image formed by the toner of the first color, the second color, or the third color that is chromatic. This makes it possible even for the second light receiving unit that is provided to receive light diffusely reflected off of another line segment to detect an achromatic toner pattern.

The optical sensor 30 may be mounted rotated 180 degrees. In such a case, the PD 35 functions as a first light receiving unit that is provided so as to receive light emitted from the light emitting unit and specularly reflected off of another line segment. The PD 36 functions as a second light receiving unit that is provided so as to receive light emitted from the light emitting unit and diffusely reflected off of one line segment.

The test image group may further include a sixth test image that is formed subsequent to the fifth test image in the moving direction and a seventh test image that is formed subsequent to the sixth test image. In this case, as illustrated by FIG. 13A and the like, the sixth test image includes one line segment (a sub-pattern Pb) formed of toner of the fourth color and another line segment (a sub-pattern Pa) formed of toner of the third color. The seventh test image has one line segment formed of toner of the fourth color and another line segment formed of toner of the fourth color. In each of the sixth test image and the seventh test image, one line segment (a sub-pattern Pb) is formed of toner of the fourth color that is achromatic on a background image formed of toner of the first color, the second color, or the third color that is chromatic. As illustrated in FIG. 13B, the background image of the sixth test image and the background image of the seventh test image may be connected in the moving direction. Thus, the total length in the V direction of the pattern group PG is reduced.

The optical sensor 30*a* is an example of a first sensor that detects a test image group formed in one end region in the width direction of the image carrier. The optical sensor 30*b* is an example of a second sensor that detects a test image group formed in another end region in the width direction of the image carrier.

The correction unit (e.g., the correction unit 1105) may reduce color misregistration by correcting an output start timing of a laser beam in an optical scanning apparatus (e.g., the exposure device 7) provided in the image forming unit. The correction unit (e.g., the correction unit 1105) may correct a magnification of an image in the main scanning direction by correcting a frequency of an image clock that affects an exposure time per pixel. This reduces color misregistration. The correction unit (e.g., the correction unit 1105) may reduce color misregistration by correcting a tilt of a toner image to be formed on the image carrier. In the case where a belt steering mechanism for modifying a traveling direction of the intermediate transfer belt 20 is employed, it becomes possible to mechanically correct the tilt of the image in the main scanning direction in accordance with the amount of misregistration of the tilt.

Other Embodiments

Embodiment(s) of the present invention can also be realized by a computer of a system or apparatus that reads out and executes computer executable instructions (e.g., one or more programs) recorded on a storage medium (which may also be referred to more fully as ('non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-061654, filed Mar. 31, 2021 which is hereby incorporated by reference herein in its entirety.

What is claimed is:

1. An image forming apparatus comprising:

an image carrier;

an image forming unit configured to form a test image group for obtaining an amount of color misregistration on the image carrier, using toners of a plurality of colors that are different from each other;

a detection unit configured to detect the test image group carried by the image carrier;

wherein the test image group includes a first test image, a second test image, a third test image, a fourth test image, and a fifth test image that are formed at different positions in order in a moving direction of the image carrier, each of the first test image to the fifth test image includes two line segments formed at different positions in a width direction perpendicular to the moving direction, the two line segments partially overlapping each other from a viewpoint in the width direction, the first test image has one line segment formed of toner of a first color and another line segment formed of toner of the first color, the second test image has one line segment formed of toner of the first color and another line segment formed of toner of a second color or has one line segment formed of toner of the second color and another line segment formed of toner of the first color, the third test image has one line segment formed of toner of the second color and another line segment formed of toner of the second color, the fourth test image has one line segment formed of toner of the second color and another line segment formed of toner of a third color or has one line segment formed of toner of the third color and another line segment formed of toner of the second color, and the fifth test image has one line segment formed of toner of the third color and another line segment formed of toner of the third color.

2. The image forming apparatus according to claim 1, further comprising:

a processor configured to acquire an amount of color misregistration based on a detection result of the detection unit and correct color misregistration of a toner image based on the amount of color misregistration, wherein the detection unit detects, for each of the first test image to the fifth test image, a position at which the one line segment is formed and a position at which the other line segment is formed, and the processor obtains an amount of color misregistration for the first color and the second color based on detection results of the first test image, the second test image, and the third test image and obtains an amount of color misregistration for the second color and the third color based on detection results of the third test image, the fourth test image, and the fifth test image.

3. The image forming apparatus according to claim 1, wherein for each of the first test image to the fifth test image, the one line segment and the other line segment are linearly symmetrical with respect to the moving direction.

4. The image forming apparatus according to claim 3, wherein for each of the first test image to the fifth test image, the one line segment and the other line segment are arranged in a V-shape.

5. The image forming apparatus according to claim 1, wherein the detection unit includes:

a light emitting unit configured to emit light toward the image carrier, a first light receiving unit provided so as to receive light emitted from the light emitting unit and specularly reflected off of the one line segment, and a second light receiving unit provided so as to receive light emitted from the light emitting unit and diffusely reflected off of the other line segment.

6. The image forming apparatus according to claim 5, wherein the test image group further includes a sixth test image formed subsequent to the fifth test image in the moving direction and a seventh test image formed subsequent to the sixth test image, each of the sixth test image and the seventh test image includes two line segments formed at different positions in the width direction perpendicular to the moving direction, the sixth test image has one line segment formed of toner of the third color and the other line segment formed of toner of a fourth color or has one line segment formed of toner of the fourth color and the other line segment formed of toner of the third color, and the seventh test image has one line segment formed of toner of the fourth color and the other line segment formed of toner of the fourth color.

7. The image forming apparatus according to claim 6, wherein in the seventh test image, the other line segment is formed of toner of the fourth color that is achromatic on a background image formed by toner of the first color, the second color, or the third color that is chromatic.

8. The image forming apparatus according to claim 7, wherein the background image of the sixth test image and the background image of the seventh test image are connected in the moving direction.

9. The image forming apparatus according to claim 1, wherein the detection unit includes:

a first sensor configured to detect the test image group formed in one end region in the width direction of the image carrier, and a second sensor configured to detect the test image group formed in another end region in the width direction of the image carrier.

10. The image forming apparatus according to claim 2, wherein the processor reduces the color misregistration by correcting an output start timing of a laser beam in an optical scanning apparatus provided in the image forming unit, a frequency of an image clock that affects an exposure time per pixel, or a tilt of a toner image to be formed on the image carrier.

* * * * *